United States Patent [19]

Cooley

[11] Patent Number: 5,064,334

[45] Date of Patent: Nov. 12, 1991

[54] WHEEL CLAMP

[76] Inventor: Lorne A. Cooley, Box 126, Pincher Creek Alberta T0K 1W0, Canada

[21] Appl. No.: 338,612

[22] Filed: Apr. 17, 1989

[51] Int. Cl.[5] ..... B66C 23/06

[52] U.S. Cl. ..... 414/428; 414/427; 414/908; 212/244; 212/238; 212/261; 294/902; 294/110.1; 901/39

[58] Field of Search ..... 414/543, 917, 921, 540, 414/426, 428, 783, 429, 430, 427, 450, 451, 452, 444, 910, 560, 462, 463, 464, 465, 466, 908; 212/261, 249, 265, 238, 243, 244, 259; 294/902, 110.1; 901/39

[56] References Cited

U.S. PATENT DOCUMENTS

| | | | |
|---|---|---|---|
| 1,591,193 | 7/1926 | Weaver | 414/428 X |
| 2,397,271 | 3/1946 | Ladwig | 212/238 X |
| 2,509,950 | 5/1950 | Zierke | 414/543 |
| 2,705,658 | 4/1955 | Barchoff | 294/902 X |
| 2,792,139 | 5/1957 | Lloyd | 414/428 |
| 2,989,197 | 6/1961 | Werner et al. | 414/543 X |
| 3,059,785 | 10/1962 | Buckeye | 212/261 X |
| 3,830,388 | 8/1974 | Mott | 414/427 X |
| 4,099,634 | 7/1978 | McIntire et al. | 414/560 |
| 4,226,331 | 10/1980 | Dumond | 212/244 X |
| 4,508,233 | 4/1985 | Helms | 212/238 X |
| 4,710,090 | 12/1987 | DeLuca et al. | 212/238 X |

FOREIGN PATENT DOCUMENTS

| | | | |
|---|---|---|---|
| 3004462 | 8/1981 | Fed. Rep. of Germany | 414/757 |
| 2066206 | 7/1981 | United Kingdom | 414/426 |

*Primary Examiner*—Frank E. Werner
*Attorney, Agent, or Firm*—William R. Hinds

[57] ABSTRACT

An apparatus for lifting a large tractor wheel includes a frame defined by feet and a post, which carries a bracket for rotation around the longitudinal axis of the post; a boom pivotally connected at one end to the bracket for rotation around a horizontal axis; a plate on the bracket for supporting a jack in engagement with the boom so that the latter can be raised and lowered; and a clamp suspended from the outer free end of the boom for raising and lowering a wheel, the clamp being defined by (i) a pair of scissor jaws with roller bearings on the bottom opposing ends thereof for engaging the opposite sides of a wheel rim or (ii) a fixed C-shaped jaw with roller bearings on the bottom and side thereof for engaging one side and rim of a wheel, and an inverted L-shaped jaw adjustably connected to the top arm of the fixed jaw for straddling the top of a tire, with a bearing on the bottom free end thereof for engaging the other side of the tire and holding the wheel in the C-shaped jaw.

7 Claims, 5 Drawing Sheets

WHEEL CLAMP

BACKGROUND OF THE INVENTION

This invention relates to a wheel lifting apparatus, and in particular to an apparatus for lifting large wheels of the type used on dual wheel vehicles.

The changing of tires or wheels on large tractors or other vehicles is usually a time consuming and difficult job. Because the wheels are large and cumbersome, removal of the wheels from the vehicle axles is not easily accomplished.

The object of the present invention is to offer a solution to the above defined problem by providing a relatively simple, lightweight apparatus for lifting such wheels.

BRIEF SUMMARY OF THE INVENTION

Accordingly, the present invention relates to an apparatus for lifting a large tractor wheel or the like comprising first jaw means; second jaw means connected to said first jaw means for straddling the tire portion of the wheel; first roller means on said first jaw means for engaging the rim of the wheel on one side of the wheel; second roller means on said second jaw means for engaging the other side of the wheel; and chain means connected to a top end of at least one said first and second jaw means for lifting both said jaw means.

DESCRIPTION OF THE DRAWINGS

The invention will be described in greater detail with reference to the accompanying drawings, which illustrate preferred embodiments of the invention, and wherein.

Figure 1:
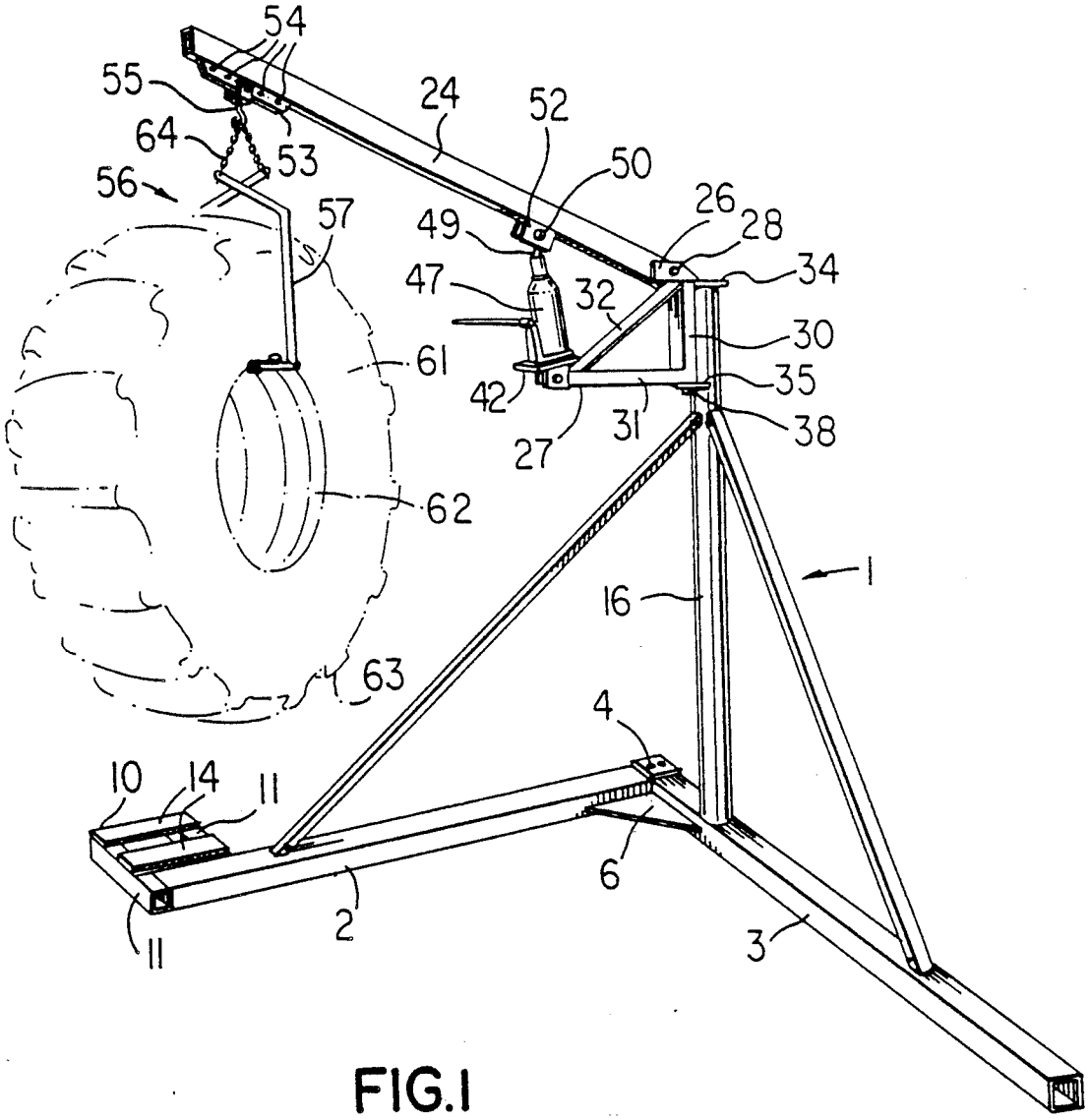
FIG. 1 is a perspective view of a wheel lifting apparatus in accordance with the present invention.
Figure 2:
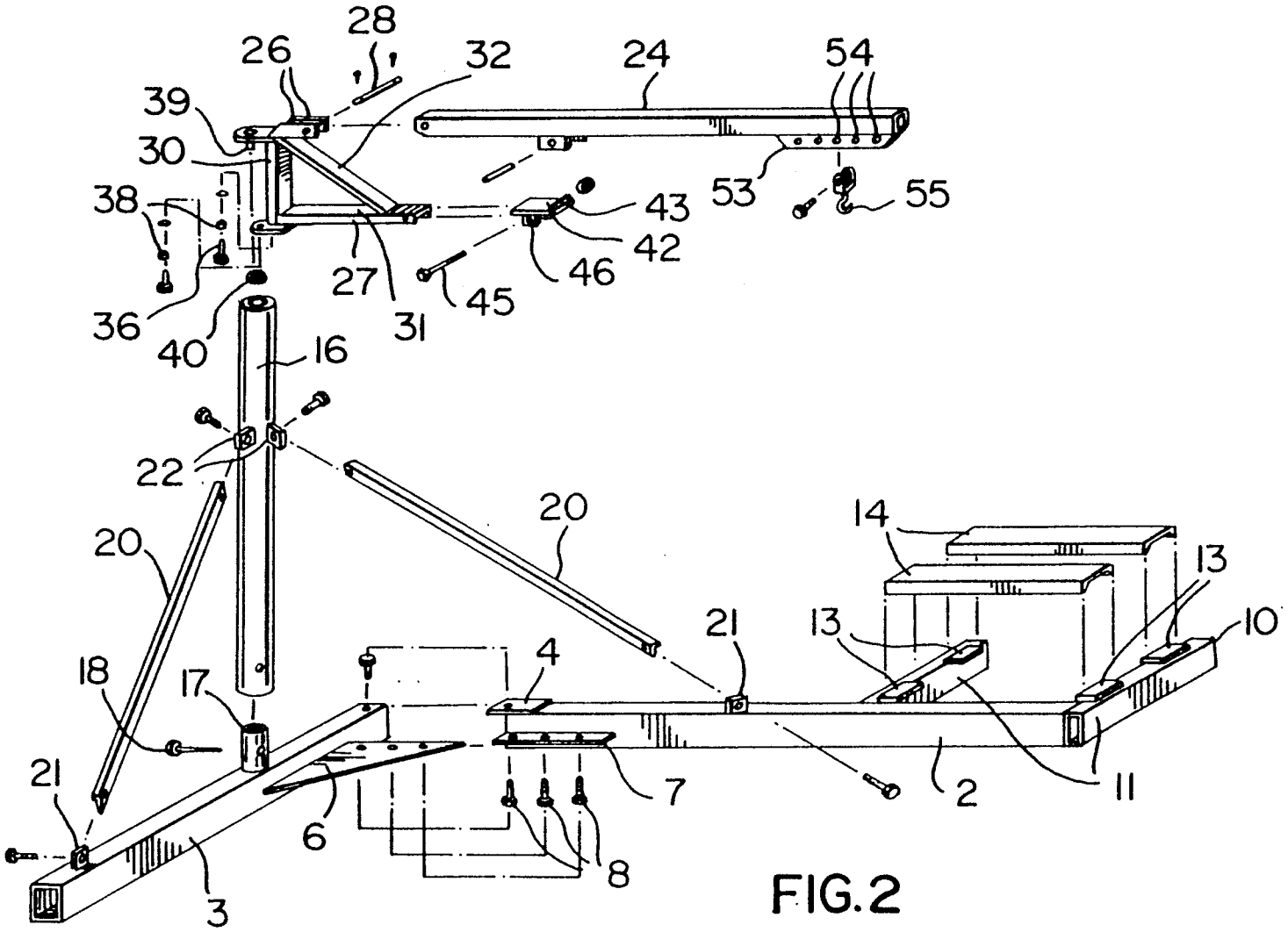
FIG. 2 is an exploded, perspective view of a wheel lifting apparatus similar to that shown in FIG. 2 with parts omitted.

It will be noted that the apparatus of FIGS. 1 and 2 are identical, except that a ramp on one is in another position on the second apparatus.

DESCRIPTION OF THE PREFERRED EMBODIMENT(S)

Referring to the drawings, the lifting apparatus of the present invention includes a frame generally indicated at 1 which is defined by a pair of elongated feet 2 and 3 defining a right angle for spreading a load over a large area, i.e. for stability. The inner ends of the feet 2 and 3 are interconnected by a top plate 4, and by a gusset 6 and plate 7 (FIG. 2). The gusset 6 and the plate 7 are interconnected by bolts 8. A wheel support ramp 10 is provided on the outer end of one foot 2. The ramp 10 is defined by a pair of short arms 11 perpendicular and connected to the foot 2. The arms 11 extend outwardly in a direction opposite to the foot 3. Plates 13 (FIG. 2) on the arms 11 receive pads 14, which form the top surface of the ramp 10.

An elongated, tubular, cylindrical post 16 is mounted on the foot 3 a short distance from the inner end thereof. The post 16 is attached to a shorter bottom tube 17 by a bolt 18, and is supported by inclined braces 20 extending between lugs 21 on the feet 2 and 3, and lugs 22 on the post 16 near the upper end thereof.

An elongated arm or boom 24 is rotatively mounted on the top end of the post 16. The boom 24 can be rotated around the longitudinal axis of the post 16 and pivoted around a horizontal axis during lifting. For such purpose, the inner end of the boom 24 is pivotally connected to a pair of vertical top plates 26 on a bracket 27 by a pin 28. The bracket 27 is rotatively mounted on the upper end of the post 16. The bracket 27 includes vertical and horizontal arms 30 and 31, respectively reinforced by a diagonal brace 32, and bottom and top mounting plates 34 and 35, respectively. The bottom plate 35 extends outwardly from the junction of the arms 30 and 31. Bolts 36 extending through the outer free end of the plate 35 carry bearings 38 for riding on the post 16. A pin 39 extends downwardly from the top plate 34 into a bearing 40 in the post 16. Thus, the bracket 27 can be rotated around longitudinal axis of the post 16.

A rectangular jack ledge 42 with a flange 43 on the outer end thereof is mounted on the outer end of the arm 31 of the bracket 27 by means of a bolt 45 extending through lugs 46 on the bottom of the ledge 42. During use, the ledge 42 supports a small manually operated hydraulic jack 47, the post 49 of which engages a pin 50 extending between the arms of a clevis 52 on the bottom of the boom 24. Thus, extension or retraction of the jack post 49 causes corresponding vertical movement of the boom 24 during pivoting thereof around the pin 28.

Figure 4:
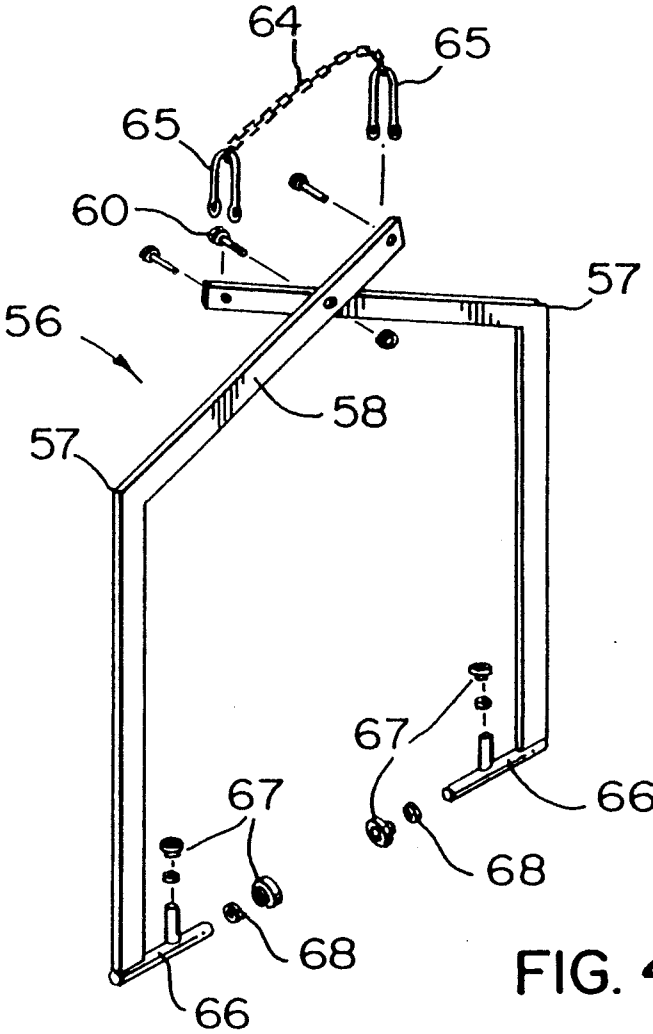
FIG. 4 is an exploded, perspective view of the clamp of FIG. 3.
Figure 3:
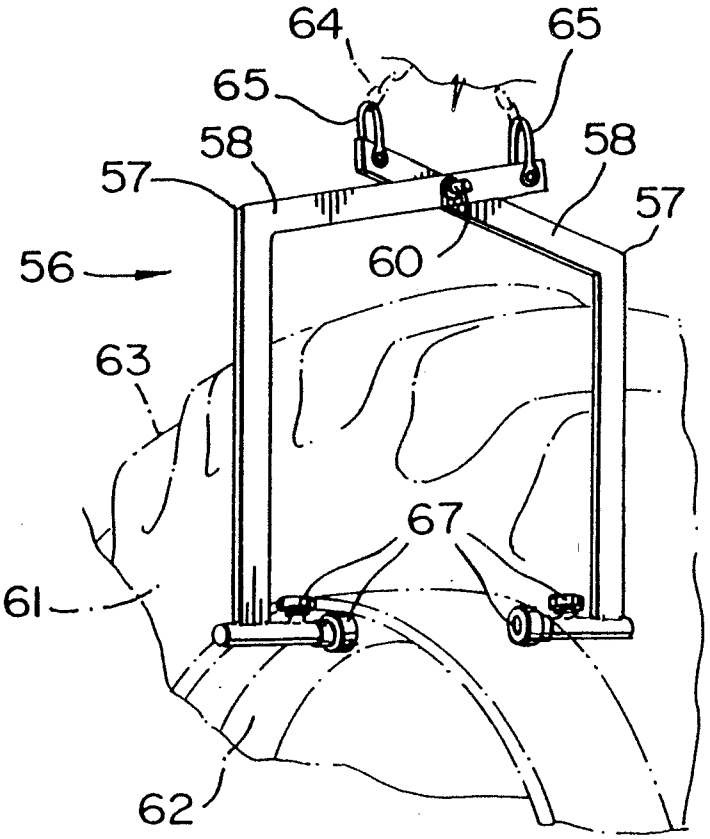
FIG. 3 is a perspective view from below of a wheel clamp used in the apparatus of FIGS. 1 and 2.

A plate 53 with a plurality of holes 54 therein is provided on the bottom of the outer free end of the boom 24 for receiving a swivel hook 55, which supports a tire clamping device generally indicated at 56 (FIGS. 3 and 4). The device 56 includes a pair of identical, elongated, generally C-shaped jaws 57 including inclined top arms 58, which are pivotally interconnected by a bolt 60 near the upper ends thereof so that the jaws 57 can be operated scissor-fashion to straddle a tire 61 and engage the rim 62 of a wheel 63. The upper ends of the arms 58 are connected to the ends of a chain 64 by clevises 65, and the chain is carried by the swivel hook 55 during use. The lower, horizontal arms 66 of the jaws 57 are defined by inverted T-shaped rods carrying roller bearings 67 at right angles to each other. The bearings are held on the arms 66 by locking collars 68.

Figure 5:
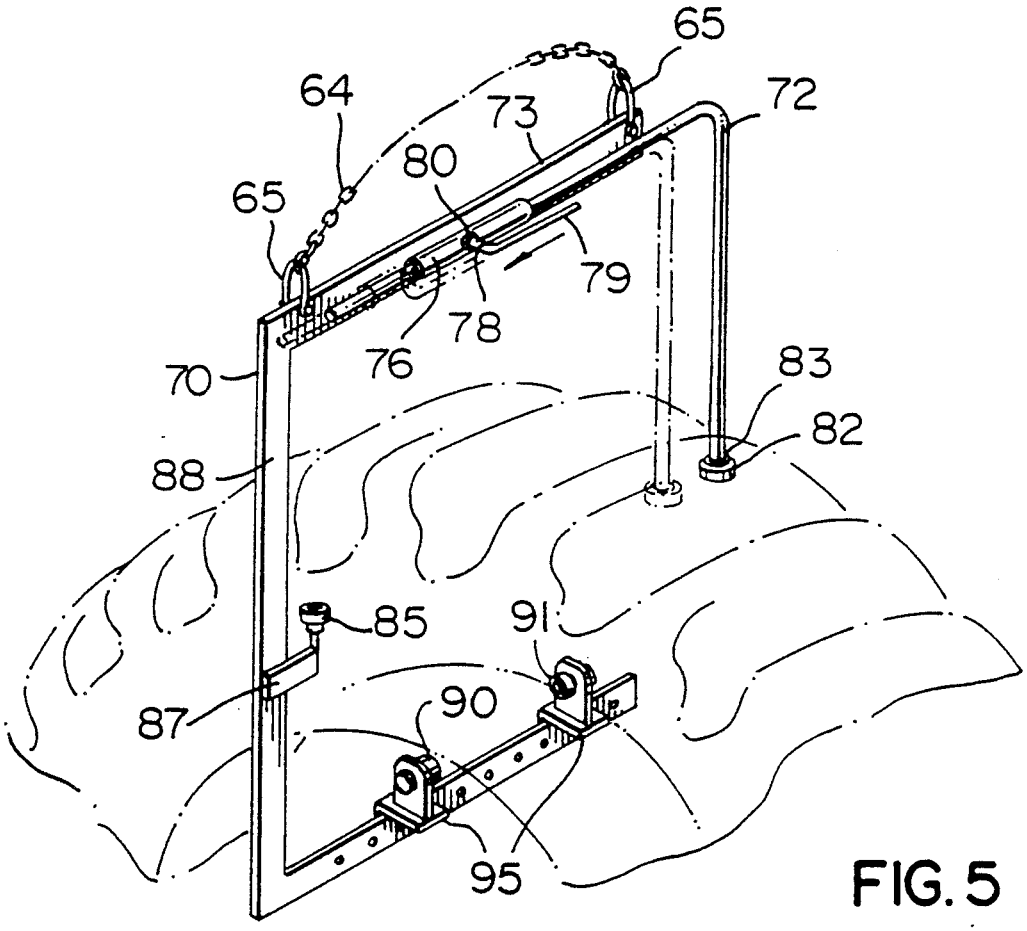
FIG. 5 is a perspective view from above of a second form of wheel clamp for use with the apparatus of FIGS. 1 and 2.
Figure 6:
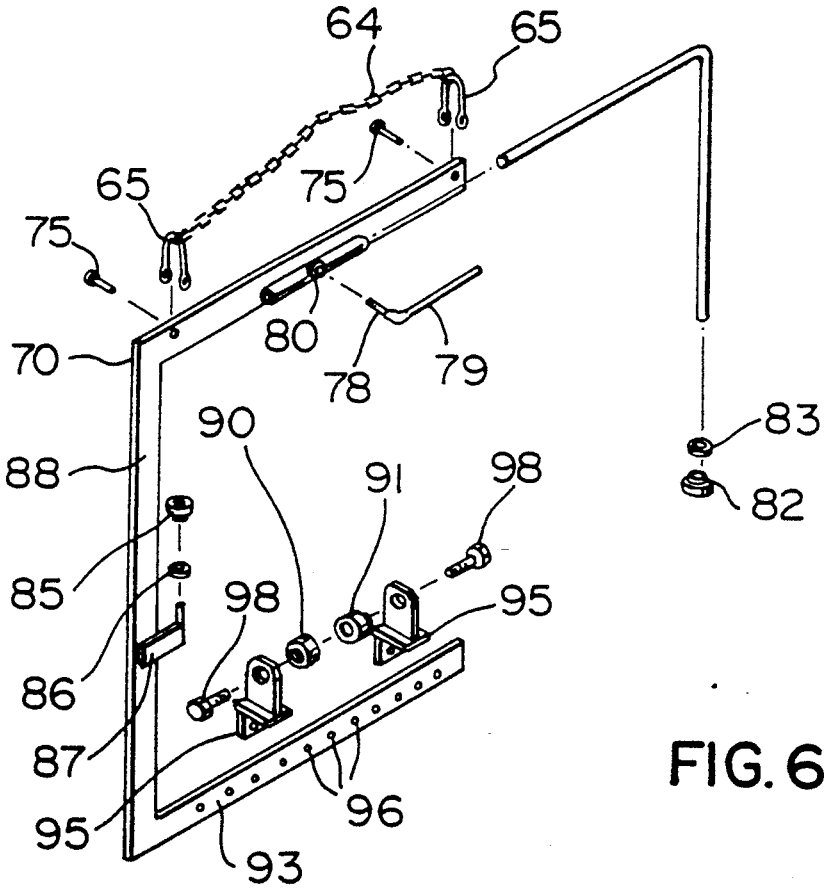
FIG. 6 is an exploded, perspective view of the clamp of FIG. 5.

With reference to FIGS. 5 and 6, in a second embodiment the jaws include one thin, generally C-shaped, planar jaw 70 for straddling the tire 61 from one side thereof (FIG. 5), and an L-shaped rod 72 defining a second jaw for extending over the top of the tire 61. The chain 64 is connected to the horizontal top arm 73 of the jaw 70 by clevises 65 and bolts 75. The rod 72 is slidably mounted in a sleeve 76 welded to one side of the arm 73. A screw 78 with a handle 79 on the outer end thereof extends through a nut 80 on the sleeve 76 and an aligned hole (not shown) in engagement with the rod 72 for securing the rod in one position. A bearing 82 and locking collar 83 are provided on the bottom free end of the rod 72 for engaging the other side of the tire 61.

A second bearing 85 and locking collar 86 are mounted on a lug 87 on the vertical arm 88 of the jaw 70. Third and fourth bearings 90 and 91, respectively are adjustably mounted on the bottom, horizontal arm 93 of the jaw 70 for engaging the interior of the rim 62. The bearings 90 and 91 are mounted on spaced apart support arms 95, which are connected to the arm 93 by bolts (not shown) extending through holes 96 in the arm 93. Bolts 98 in the top ends of the arms 95 carry the bearings 90 and 91.

In use, in order to replace a wheel or tire on a tractor of the type including wheels in pairs, the tractor is driven onto the frame, i.e. one wheel of a pair of wheels is positioned on the ramp 10 to stabilize the frame 1. As best shown in FIG. 1, with the embodiment of clamping device of FIGS. 3 and 4, the jaws 57 of a clamping device 56 are manually positioned to straddle the tire 61 of the outer wheel 63 of the pair of wheels. The bearings 67 are placed against the rim 62 of the wheel 63, with the outermost of each pair of bearings 67 against the beaded outer periphery of the rim. When the device of FIGS. 5 and 6 is used, the screw 78 is loosened, and the device is placed on a wheel so that the bearings 90 and 91 engage the rim on one side of the wheel and the bearing 82 presses against the opposite side of the tire. A jack 47 is placed on the ledge 42 with the post 49 of the jack in engagement with the pin 50. By manually operating the jack 47, the boom 24 is caused to rise. Thus, the chain 64 is pulled upwardly with the jaws 57 or 70 and 72 and the wheel 63. Because of the scissors action of the jaws 57, lifting of the device 56 of FIGS. 3 and 4 tends to force the bottom ends of the jaws 57 together, preventing jaw separation and unintentional dropping of a wheel 63. The rod 72 defining the second jaw of the second embodiment of clamping device performs the same function.

It will be appreciated that while the lifting apparatus described herein is primarily intended for use with dual wheel vehicles, by holding the frame 1 down, the apparatus could be used with single wheel vehicles, i.e. vehicles with single wheels on the ends of the axles thereof.

What I claim is:

1. An apparatus for lifting a large vehicle wheel comprising a tire mounted on a rim, the apparatus comprising first jaw means; second jaw means connected to said first jaw means such that the first and second jaw means can straddle the upper portion of the wheel with the wheel in its upstanding position; first roller means on said first jaw means for engaging the upper part of the rim of the wheel on one side of the wheel; second roller means on said second jaw means for engaging the upper part of the rim of the wheel on the other side of the wheel; and lift means connected to upper ends of said first and second jaw means for lifting both said jaw means, said first jaw means having at least one first roller with its axis oriented generally horizontally for engaging an underside of the upper part of the rim of the wheel and a second roller oriented generally normal to the first roller for engaging an adjacent side surface of the wheel, said second jaw means having rollers corresponding to those of said first jaw means for engaging an underside of the upper part of the rim and an adjacent side surface of the wheel at the other side of the wheel, said first and second rollers of each jaw means constituting said roller means of the respective jaw means, the connection between said jaw means comprising pivot means pivotally connecting said first and second jaw means in scissors fashion such that said jaw means and said rollers are movable inwardly toward and outwardly away from a straddled wheel, and said lift means being connected to said upper ends of said first and second jaw means such that a lifting force by said lift means urges said first and second jaw means inwardly toward a straddled wheel.

2. An apparatus according to claim 1, wherein said lift means comprises chain means, and further including frame means for carrying said chain means, and consequently said first and second jaw means in an elevated position, and for raising and lowering a wheel grasped by said first and second jaw means.

3. An apparatus according to claim 2, wherein said frame means includes elongated foot means, post means extending upwardly from said foot means; and boom means carrying said chain means pivotally mounted on said post means for rotation around a horizontal axis for raising and lowering a wheel.

4. An apparatus according to claim 3, including bracket means on said frame means carrying said boom means for rotation around said horizontal axis, said bracket means being rotatively mounted on said post means for rotation around the longitudinal axis thereof.

5. An apparatus according to claim 4, including pad means on said bracket means for supporting a jack in contact with said boom means.

6. Apparatus as claimed in claim 1 wherein said first and second jaw means are generally C-shaped, and said first and second rollers of each C-shape are mounted on the bottom arm of the C-shape such that the second roller bears against a side surface of the rim of the wheel.

7. Apparatus as claimed in claim 1 wherein said second roller of each said jaw means is positioned and arranged to engage a beaded outer surface of the upper part of the rim while said at least one first roller of the same jaw means engages the adjacent underside of the upper part of the rim.

* * * * *